US006632046B2

(12) United States Patent
King et al.

(10) Patent No.: US 6,632,046 B2
(45) Date of Patent: Oct. 14, 2003

(54) MOLD LINER FOR FACILITATING MANUFACTURE OF REINFORCED DRAINAGE BLOCKS

(75) Inventors: Robert James King, Herts (GB); David Neil Robertson, Bedford (GB)

(73) Assignee: ACO Polymer Products, Inc., Chardon, OH (US)

( * ) Notice: Subject to any disclaimer, the term of this patent is extended or adjusted under 35 U.S.C. 154(b) by 0 days.

(21) Appl. No.: 09/932,125

(22) Filed: Aug. 17, 2001

(65) Prior Publication Data

US 2002/0020798 A1 Feb. 21, 2002

(30) Foreign Application Priority Data

Aug. 21, 2000 (GB) ..... 0020512

(51) Int. Cl.[7] ..... E02B 5/00; E02B 9/04
(52) U.S. Cl. ..... 405/119; 404/2
(58) Field of Search ..... 405/118–123; 404/2–4

(56) References Cited

U.S. PATENT DOCUMENTS 5,066,165 A * 11/1991 Wofford et al. ..... 405/119
5,281,051 A * 1/1994 Stegall ..... 405/118
5,613,804 A * 3/1997 Beamer ..... 405/119
6,000,881 A 12/1999 Becker et al. ..... 405/119

FOREIGN PATENT DOCUMENTS

| | | |
|---|---|---|
| DE | 26 47 585 | 4/1978 |
| GB | 2315792 | 2/1998 |
| GB | 2316428 | 2/1998 |
| GB | 2318081 | 4/1998 |
| GB | 23182081 | 4/1998 |
| GB | 23511109 | 12/2000 |

* cited by examiner

*Primary Examiner*—Thomas B. Will
*Assistant Examiner*—Tara L. Mayo
(74) *Attorney, Agent, or Firm*—Cowan, Liebowitz & Latman, P.C.; Mark Montague

(57) ABSTRACT

A liner for use in casting a drainage block has an arched surface which defines an upper profile of a main drainage channel and the water inlets opening into the outer surface of the block as well as providing clips for supporting and locating reinforcing bars during the casting of the blocks.

4 Claims, 2 Drawing Sheets

MOLD LINER FOR FACILITATING MANUFACTURE OF REINFORCED DRAINAGE BLOCKS

BACKGROUND OF THE INVENTION

The present invention relates to reinforced drainage blocks and, more particularly, to a mold liner for facilitating the manufacture of such blocks.

The present invention is concerned with the casting of polymer concrete drainage blocks which define a main drainage channel extending from end to end of the block and water inlet passages which extend from openings in the external wall of the block into the main drainage channel.

The present invention relates to curb drainage blocks such as those described in GB-A-2315792 and GB-A-2351109, which are sold by the assignee under the registered trademarks ACO KERBDRAIN and ACO ROADDRAIN. The disclosures of GB-A-2315792 and GB-A-2351109 are incorporated herein by reference.

Where such blocks are required to withstand heavy loading, as in industrial applications and on road carriageways, it is necessary to reinforce the concrete particularly in the area of the thinner sections surrounding the waterway inlets. The technical problem is to locate the reinforcing bars in the correct position during the casting process.

One method of casting such blocks using a hollow plastics liner is described in GB-A-2318081, which is incorporated herein by reference. The present invention is a development of this technique though the liner may be made of materials other than plastic.

SUMMARY OF THE INVENTION

In accordance with the present invention there is provided a drainage block liner for use in molding a drainage block, which liner defines at least part of the shape of a main drainage channel of a block to be molded and having sections which define additional openings and passages intended to communicate with the main drainage channel; characterised in that the liner is provided with transverse side bars extending parallel to the main drainage channel on either side of the passages; each bar bearing a plurality of spaced clips for retaining a respective end of a reinforcing bar, which, when mounted in aligned clips will be held in the space between the passages so that when a block is cast the bar will be surrounded by the casting material.

Using a liner that can stay in position in the finished block conveniently allows a required number of drainage bars to be positioned securely during the casting process.

The liner is preferably used with a polymer concrete casting material that will flow around the bars.

The liner may be made of metal, such as cast iron or steel, or plastics such as polypropylene

BRIEF DESCRIPTION OF THE DRAWINGS

In order that the invention may be well understood an embodiment thereof will now be described, by way of example only, with reference to the accompanying diagrammatic drawings, in which.

DETAILED DESCRIPTION OF A PREFERRED EMBODIMENT

Figure 1:
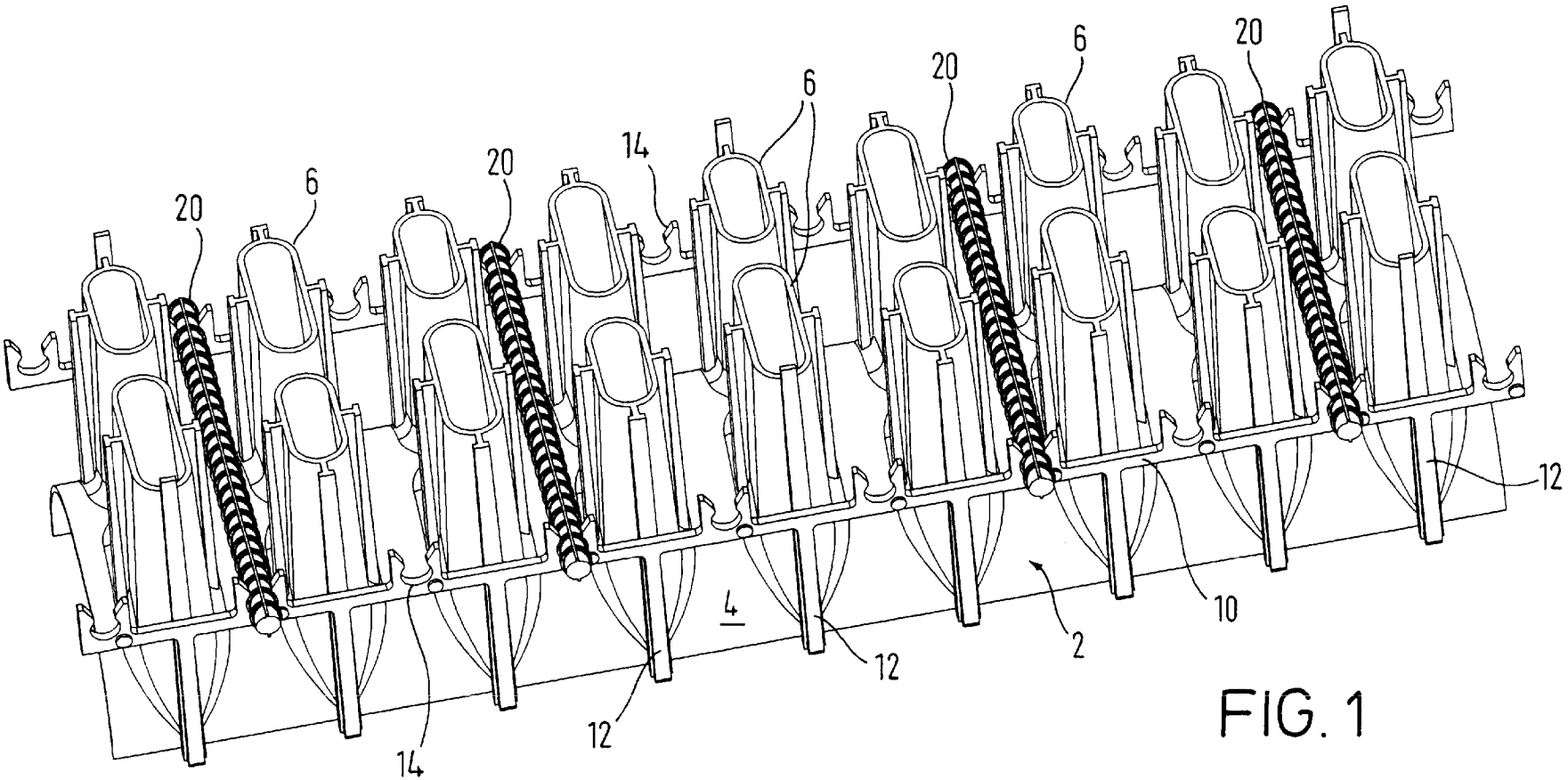
FIG. 1 shows a perspective view of a liner with reinforcing bars fitted.
Figure 2:
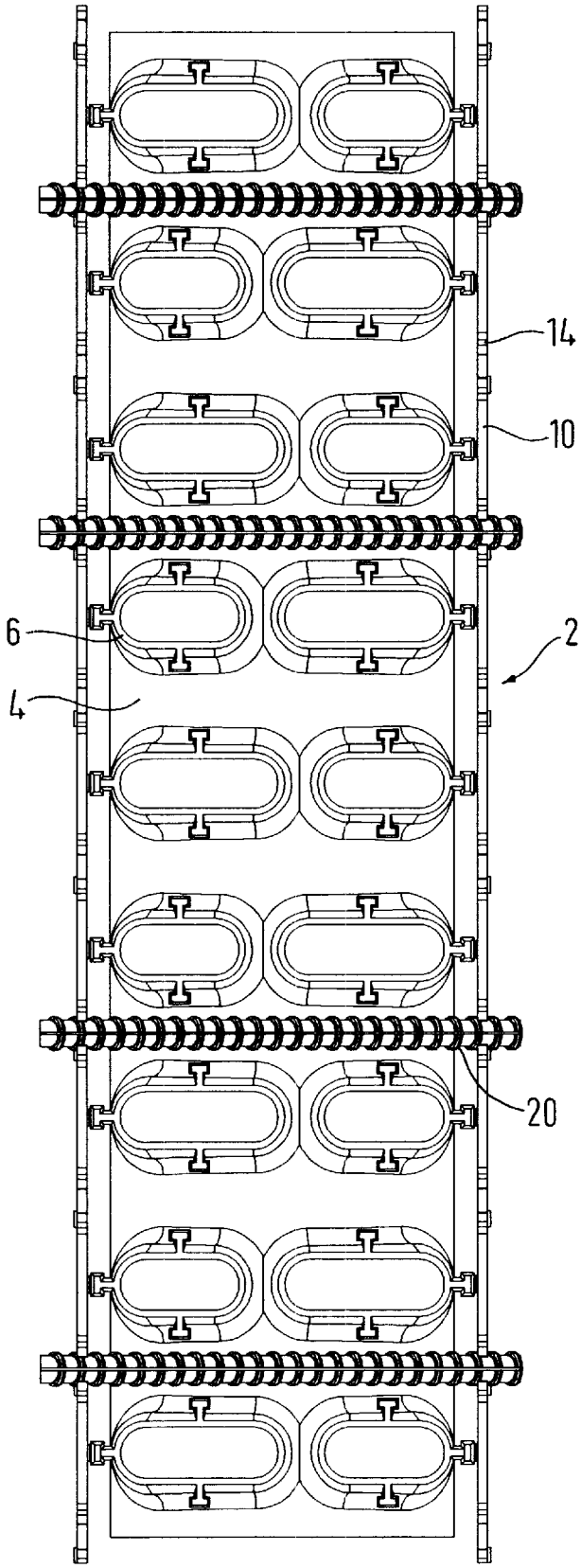
FIG. 2 shows a top plan view of the liner of FIG. 1.

A liner 2, as shown in FIGS. 1 and 2, is intended for the construction by casting of a drainage block which has a main drainage channel extending between openings in opposite end faces of the block. Additional water inlet openings in the outer walls of the block are connected to the main drainage channel by means of passageways that open into the outer walls of the block. In the embodiment described the liner 2 is intended for casting an ACO ROADDRAIN (registered trade mark) block in which the additional openings are in an upper surface of the block designed to lie just below the level of the carriageway surface to be drained.

It will be appreciated that liners can be constructed on the same principles for other designs of block. In particular for blocks where the additional openings are in other faces of the block.

The liner 2 has an arched surface 4 which defines an upper profile of a main drainage channel. Tubes 6 which merge into openings in the arched surface define passageways which in the finished block will extend from an upper surface of the block into the main drainage channel. The liner 2 is intended to be used with another part (that may be removable from the finished block) that defines the lower portion of the profile of the main drainage channel.

In the present embodiment, the liner 2 is molded from polypropylene. Other plastics materials may also be used such as styrene, low density polyethylene, ABS or uPVC. Alternatively, the liner may be made of metal such as cast iron or steel.

Side bars 10 extend along each side of the liner within the intended side wall surface of the finished block. These side bars are supported in a position above and parallel to the main axis of the block by means of spaced stems 12 supported on the edges of the arched surface 4. Upstanding clips 14 are formed between the junctions of the stems 12 with the side bar 10. These clips 14 are aligned on the side bars 12 on opposite sides of the liner 2 and are positioned centrally between the tubes 6.

The clips 14 are sized to snap fit around ends of a conventional steel reinforcing bar 20. In use (as shown in the figures) bars 20 are clipped into position at intervals along the liner. In this case, four bars are used but the number will depend on the loads that the finished block is designed to withstand. The bars 20 are spaced between the tubes 6 so that there is sufficient space for the casting material to flow around them when the completed mold is vibrated so that the bars 20 are set firmly into the finished block.

Drainage blocks can be cast from polymer concrete or other casting materials.

The plastics liner 2 is used in conjunction with a conventional mold having a base which forms an upper surface of the block and four walls which each define one side face of the block. The required reinforcing bars 20 are positioned in the clips 14 and the liner 2 is then inverted and placed upside down in the mold with the open faces of the tubes 6 supported on the base. The mold is then completed with another arched liner part that sits on the edges of the arched surface of liner 2 to define the main drainage channel. The mold is then filled with a wet polymer concrete mix or other casting material and the mold is vibrated so that the casting material flows all round the liner and between the tubes 6 and bars 20. Once set, the side walls and base of the mold are removed. The plastics liner 2 remains in position in the finished block but the other part of the liner can be removed or left in position as desired.

If the other arched liner part is to be removed it may constructed as a solid element.

While the present invention has been particularly shown and described in conjunction with a preferred embodiment thereof, it will be readily appreciated by those of ordinary skill in the art that various changes may be made without departing from the spirit and scope of the invention.

Therefore, it is intended that the appended claims be interpreted as including the embodiments described herein, the alternatives mentioned above, and all equivalents thereto.

What is claimed is:

1. A drainage block liner, which liner defines at least part of the shape of a main drainage channel and having sections which define additional openings and passages intended to communicate with the main drainage channel; the liner comprising:

transverse side bars extending parallel to the main drainage channel on different sides of the passages, each of the side bars having a plurality of spaced clips for retaining a respective end of a reinforcing bar, aligned pairs of the clips being adapted to hold a respective reinforcing bar in a space between the passages and transverse to the main drainage channel.

2. The drainage block liner of claim 1, wherein the liner is made of polypropylene, styrene, low density polyethylene, acrylonitrile, butadiene, styrene (ABS) or unplasticized polyvinyl chloride (uPVC).

3. A combination, comprising:

a drainage block liner adapted to define a part of a shape of a main drainage channel, said liner having sections which define additional openings and passages to communicate with the main drainage channel, the liner including transverse side bars extending parallel to the main drainage channel on different sides of the passages;

a plurality of reinforcing bars;

each of the side bars of the drainage block liner having a plurality of spaced clips for retaining a respective end of one of the reinforcing bars, and aligned pairs of the clips being adapted to hold a respective reinforcing bar in a space between the passages and transverse to the main drainage channel.

4. The combination of claim 3, wherein the liner is made of polypropylene, styrene, low density polyethylene, acrylonitrile, butadiene, styrene (ABS) or unplasticized polyvinyl chloride (uPVC).

* * * * *